US005816347A

United States Patent [19]

Dennis et al.

[11] Patent Number: 5,816,347

[45] Date of Patent: Oct. 6, 1998

[54] PDC CLAD DRILL BIT INSERT

[75] Inventors: Mahlon Denton Dennis, Kingswood; Eric Twardowski, Houston, both of Tex.

[73] Assignee: Dennis Tool Company, Houston, Tex.

[21] Appl. No.: 661,584

[22] Filed: Jun. 7, 1996

[51] Int. Cl.[6] ..... E21B 10/46

[52] U.S. Cl. ..... 175/432

[58] Field of Search ..... 175/432, 428, 175/433, 434

[56] References Cited

U.S. PATENT DOCUMENTS

| | | | |
|---|---|---|---|
| 5,351,772 | 10/1994 | Smith | 175/432 |
| 5,355,969 | 10/1994 | Hardy et al. | 175/432 |
| 5,486,137 | 1/1996 | Flood et al. | 175/432 |
| 5,544,713 | 8/1996 | Dennis | 175/434 |
| 5,564,511 | 10/1996 | Frushour | 175/431 |
| 5,590,728 | 1/1997 | Matthias et al. | 175/432 |
| 5,598,750 | 2/1997 | Griffin et al. | 175/428 |
| 5,605,199 | 2/1997 | Newton | 175/432 |
| 5,622,233 | 4/1997 | Griffin | 175/432 |
| 5,662,720 | 9/1997 | O'Tighearnaigh | 51/295 |

FOREIGN PATENT DOCUMENTS

| | | | |
|---|---|---|---|
| 462091 | 12/1991 | European Pat. Off. | 175/434 |

*Primary Examiner*—Hoang C. Dang
*Attorney, Agent, or Firm*—Gunn & Associates, P.C.

[57] ABSTRACT

An insert construction is set forth comprising a right cylinder insert body crowned with a PDC crown bonded thereto defining an interface between the two materials. The interface construction is described in geometric terms. The interface includes irregular curvilinear sided depressions to enhance the interface grip between the two materials thereby reducing shear stress concentration which might damage the PDC crown. Other failure modes are reduced also. Relationships are set forth in the amount, depth, and shape of the depressions.

13 Claims, 2 Drawing Sheets

FIG.1
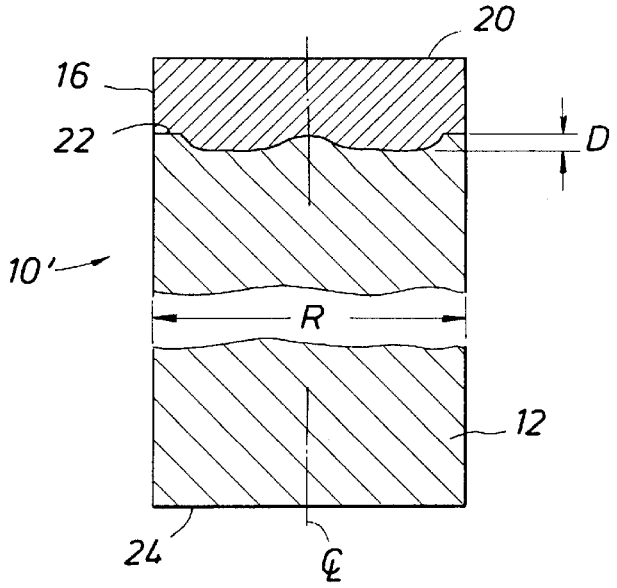
FIG. 2
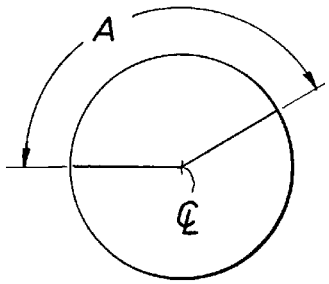
FIG. 4
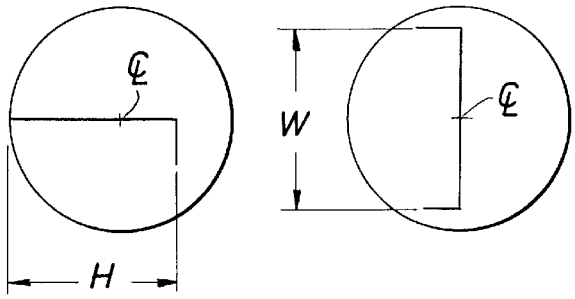
FIG. 3
FIG. 13
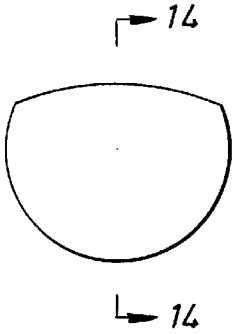
FIG. 14
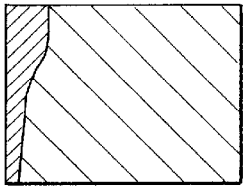

PDC CLAD DRILL BIT INSERT

BACKGROUND OF THE INVENTION

The present disclosure is directed to a PDC clad insert and in particular to a PDC clad drill bit insert capable of use in drill bits which are subject to wear, abrasion, shock, and damage. The device is also applicable to other cutting and wear applications. When a drill bit is placed in a well borehole, the drilling process uses the drill bit to advance the well borehole. During drilling, the drill bit is rotated so that the bit bears against the face of the well borehole. As the well is drilled, the drill bit is rotated, causing inserts on the drill bit to rotate against the working face, and thereby breaking the formation and extending the borehole. In part, this involves rotating movement of the cone so that the end of inserts on the cone bear against the well borehole working face and break the formation material. This process is continued until the drill bit wears out. Wear on the drill bit is normally evidenced by wear of a large number of the inserts.

Drill bits are made in several categories, one utilizing milled teeth which extend outwardly from a one piece metal body which is shaped into a cone. While that type bit meets with great success, a second even more expensive but longer life drill bit utilizes inserts which are mounted in holes appropriately located on the drill bit cone. The inserts are placed in these holes at the time of manufacture. The drill bit inserts have to be shrunk while the hole is enlarged temporarily so that an interference fit is accomplished. The insert is made of extra hard material. Indeed, and compared with the milled tooth cone just mentioned, the inserts are quite hard in comparison because they are made of various carbides. The preferred form is tungsten carbide particles which are molded into an elongate cylindrical body. The tungsten carbide (WC is the chemical symbol) forms a molded body where particles of WC are held in a cylindrical shape by a cobalt bonding alloy. The WC particles are thus bonded together to form the drill bit insert. This provides a very hard metal member which is able to sustain substantial wear and tear.

To make the insert even more durable, it is necessary to add crystalline material which covers over the end of the insert. The crystalline material is comprised of polycrystalline diamond compact material. That material is especially hard and is able to handle all sorts of wear and tear. It is however somewhat brittle. If quite large, it tends to break or fracture with shock impact. Many patents have been issued describing methods of construction for the PDC clad inserts. The present disclosure sets forth a different mode of construction so that the PDC layer or crown can be readily attached. In particular, the PDC crown is attached to the end of the WC composite material body having a bonding layer between the PDC crown or cap and the WC insert body. In the normal course, the insert is formed by molding. That is, WC particles are placed in a mold and mixed with cobalt and selected trace metals. On heating, the binder materials including the cobalt melt and fill the crevices and cracks between the particles to provide a bonded insert construction capable of withstanding substantial wear and tear in use. The end face is subsequently bonded to anchor the PDC layer on the end of the insert. This bonding is accomplished by casting in place the PDC material in a cavity mold adjacent to the insert body, thereby bonding the PDC layer to the WC insert. This bonding is achieved so that the two materials of different natures are joined together.

The insert body formed of WC has a certain measure of resilient rugged construction and is able to provide some yield during use. It is more malleable and resilient in comparison with the PDC layer. By contrast, the composite layer making up the PDC crown is more brittle, harder at the surface, and is therefore more subject to fracture which leads to a catastrophic failure. It is long lasting in that the PDC layer is relatively slick and is able to slide across a confronting surface. The PDC layer must be viewed however as a brittle structure. The bonding material (an alloy including cobalt) in the insert defines an insert body which is able to yield somewhat. The PDC crown however does not yield readily; rather than yield, it may well fracture, break, or splinter. This results from the fact that it is more rigid in structure. The PDC layer is therefore quite different from the WC insert body formed by a cobalt alloy matrix. On the one hand, the WC is somewhat more resilient but not as strong. The PDC layer is stronger but more brittle and wear resistant.

There are two or three common modes of failure. In one mode of failure, a shock impact is applied to the PDC crown or layer on the end of the insert and it chips off one side of the PDC crown. The chip can develop a break line or cleavage at an angle depending on the position of the crystalline structure. There is also the added sensitivity to elevated temperature. At elevated temperatures, shear stress in the PDC layer can build up because the PDC material has a different thermal expansion coefficient compared with the WC body. Therefore when exposed to a temperature differential, e.g., when placed in a hot well borehole for a long time, drift in temperature occurs and builds up substantial stresses as a result of the temperature change.

Assume that the PDC layer is an unstressed laminar sheet covering. Assume further that the change in temperature during use creates some stress. There is a stress build up at the interface between the PDC layer and the WC layer. Assume for purposes of description that the interface is a planar surface. There is a thin sheet of bonding material between the two, and there is therefore a very large stress concentration in that region tending to break the PDC layer free from the WC insert. In many instances, the WC insert is made with a curving or rounded surface. There are many patents which set forth this type of construction. This enables the PDC layer to grip or hold more readily. The grip is enhanced by forming the PDC-WC interface with shapes so that the interface is irregular, something in the fashion of an interlocked surface area. This interlocking construction is effective in many aspects but it increases the cost in that more complicated surfaces are required. This makes the manufacturing somewhat more difficult. The device is more durable and is able to last longer if the interface is irregular, but it tends to break more readily along certain planes if they concentrate stress in use. More precisely, the WC insert body can often be fabricated with a number of interlocking interfaces which are at right angles. In a WC insert construction, where the PDC layer abuts a right angle shoulder (one which is perpendicular to the end face of the WC insert body), there is always the risk of a fracture propagating along that interface. This is especially true where the interface is a long straight line. For instance, a square button on the end of the WC insert body which is covered by a PDC material will typically localize fractures so they run along the interface and propagate in a way so that a chip along one side of the square is knocked loose. While total failure of the PDC crown is avoided, a very substantial failure can occur.

In another aspect of that failure mode, it has been determined that chipping parallel to a straight face is a problem and delamination is a related problem also. In both instances, the chips or fractures do not simply accumulate over time; they extend rapidly and destroy the entire PDC layer. This results in part from the rugged environment in which the PDC covered insert is used. There is some risk that this delamination or corner chipping will occur whether or not the interface between the PDC layer on the end and the WC insert body that supports it has a simple planar face or an irregular face such as a raised rectangular (or square) button on the WC body.

The present disclosure is directed to a construction of PDC-WC interface so that the delamination or corner chipping is reduced, and ideally is avoided. In the preferred method, the interface is an undulating surface which has an asymmetric construction which diverts stress, thereby avoiding stress concentrations. The end face of the WC insert body is formed as a cast blank prior to placing the PDC crown on the irregular end face. It is formed with a generally flat end face with a number of depressions in it. The depressions can have sides which are curving and which slope inwardly with a variable radius of curvature. The PDC layer is formed on top of that to define a continuous PDC layer which ranges anywhere from 0.01 up to about 0.120 inches in thickness and which presents a substantially planar surface which is flat or rounded. The end surface is circular and the end face is made with a number of depressions in it. They can be regular but are more successful if irregular. The present disclosure sets forth in one aspect of the invention the relationship by which they are made irregular. More specifically, the irregular depressions are incorporated so that the irregular depressions form a PDC-WC interface where there is substantially little likelihood of gripping or grasping between the two to the extent that undue stress concentrations are located at the interface. This accommodates the differences in the brittleness of the two materials, and therefore fracture. This also accommodates changes in temperature. The present apparatus especially is effective in preventing delamination or corner chipping.

The improved system of the present disclosure is able to resist both types of fractures in a way that enables continued operation for longer drilling intervals since there is an adequate grip between the two. The grip is enhanced and therefore the grip lasts much longer so that the PDC clad insert does not wear rapidly. Relationships are set forth which define the extent of the depressions so that the grip assures that the PDC layer is held for a much longer drilling interval. This improved PDC layer is also advantageous in the third type of drill bit construction which is called drag bits with cutters attached mechanically or by brazing to the bit body.

In the present disclosure, a relationship is set forth with regard to the included angle at which depressions are located with respect to the centerline axis, and another aspect of this is defined so that the amount of depression wall in the interface is emphasized also. In the latter aspect, the depression wall is sized so that it holds with regard to both length and width. This accommodates a curving or irregular depression wall or edge. In other words, there need not be a straight line component to the depression for the depression to hold firmly. These relationships will be developed in detail hereinafter.

SUMMARY OF THE INVENTION

The present disclosure summarizes an interface construction between the PDC and WC layers of a composite material drill bit insert and in particular defines that interface so that delamination or chipping of the corner is reduced, and ideally avoided. In one aspect, the irregular depressions formed in the end of the insert body have an included angle measured from a centerline prospective, and also have a height and width across the face of the insert body extending to a specified depth so that a grip is obtained and yet cracks do not propagate along straight-line segments.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a drill bit insert constructed in accordance with the present disclosure and showing in particular certain aspects of the drill bit insert which are marked by the symbols D and R;

FIG. 2 is an end view of the insert body showing an included angle;

FIGS. 3 and 4 are views similar to FIG. 2 showing height and width measurement of depressions in the interface on the insert body; and FIGS. 5–14 each show a variety of insert faces which are constructed with depressions and wherein the depressions have a pattern conforming with a relationship set forth in the present disclosure.

DETAILED DESCRIPTION OF A PREFERRED EMBODIMENT

Figure 5:
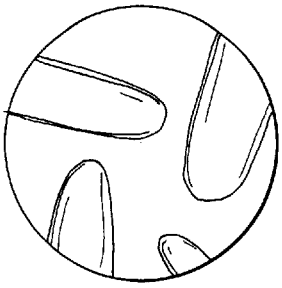

Attention is now directed to FIG. 1 of the drawings where a molded and formed insert 10 is constructed so that it might be installed in a drill bit for use in drilling. Moreover, the structure of the insert 10 typically has the shape of an elongate right cylinder of bonded carbide particles, the preferred form being tungsten carbide particles, and they are shaped into the right cylinder construction which comprises the insert body 12. The top surface 20 may be flat, rounded, conical or other shape. The bonding material is typically an alloy, and the preferred alloy is cobalt based, there being additional trace metals added to that so that bonded tungsten carbide particles are held together in the solid right cylinder construction shown in FIG. 1. The typical manufacturing procedure is to mold or cast the WC particles together commingled with a sufficient amount of the alloy material that, on the application of appropriate pressure and temperature, the material forms the alloyed solid structure which is extremely hard as a result of the inclusion of the WC particles in the insert body 12. Typically, the insert body is made of about 60% up to about 90% WC particles and the remainder is the alloy material. It is both hard and very shock resistant. It is able to resist abrasive wear quite readily. Notwithstanding the fact that it is quite hard and has a high level of abrasion resistance in its own characteristics, it is enhanced by the incorporation of a polycrystalline diamond compact (PDC) crown which is bonded to the outer end. The bonded PDC crown 16 continues the right cylinder construction. It terminates in a substantially planar end face 20 in the best embodiments. It is fabricated with dispensed small diamond particles which are joined together with a bonding agent. The PDC crown on the insert body 12 adds even greater hardness to the finished product. It is also able to resist abrasion quite readily. There are differences in physical characteristics between the two materials which create difficulties at the interface. The interface between the two materials is the major topic of the present disclosure.

The interface 22 is constructed with one or more irregular shaped depressions as will be described. These depressions enable the two materials to bond together at the interface so that the two materials have an irregular shape. More specifically, the two materials bonded together at an irregular face, formatting, or matching surfaces, the surfaces bonded so that stresses created in use do not concentrate in such a fashion as to cause delamination of the PDC crown. The surfaces also do not concentrate stress so that the corners are prevented from chipping off one side or one corner or the PDC crown when applied in drilling, milling, turning or other wear applications The depressions are formed at the time of fabrication of the body 12. The insert body is thus made first and is made with the depressions. The depressions typically have a curvilinear shape. The thickness of the PDC crown 16 is typically in the range of about 0.02 up to about 0.1 inches. It comprises a continuous PDC layer. The PDC layer 16 has a different thickness in the areas where the depressions occur. As shown in FIG. 1, the depressions, considered in cross-section, form a depression border or edge which has a height with respect to the maximum depth of the depressions. This height is represented by D. The depression depth or height D is measured from the face 22 to the bottom of the depressions. It is typically common to fabricate the end face 22 of the insert body 12 with a substantially planar shape. It is not required that this be uniform but it is more convenient at the time of fabrication that the face 22 be approximately parallel to the end face 20 on the PDC crown and also parallel to the bottom face 24 at the far end of the insert body 12. The face 22 may in some cases intercept the cylindrical outer surface of the insert body 12 at a straight run so that inspection after fabrication will show a straight line extending fully around the insert body. When that line is straight, it is adequate to define the planar face 22 at right angles with respect to the centerline axis of the insert body 12 as marked in FIG. 1 of the drawings. As also marked, the insert body is cylindrical and has a diameter which is indicated by the symbol R. That diameter is used in certain relationships as will be discussed with regard to the depressions in the insert body 12.

Going now to FIG. 2 of the drawings, the centerline axis of the cylindrical insert body is again shown. FIG. 2 also shows an included angle A which will be described in a particular relationship below. FIGS. 3 and 4 also indicate nomenclature of the depressions which are marked with the measures of H and W. H and W are measured at right angles with respect to each other.

FIGS. 5–14 show a variety of depressions. These depressions have been omitted from FIGS. 2, 3, and 4 so that an explanation can be provided using the measures shown in FIGS. 1–4. The variety of depressions shown in FIGS. 5–14 is representative of the manner in which the depressions can be formed. Moreover, the depressions that are illustrated in FIGS. 5–14 are not exhaustive of the depressions that can be formed and yet provide a quality interface bonding connection between the PDC crown and the WC insert body. They are simply representative.

For an insert size where R is less than 0.5 inches, the typical range for D is up to about 0.08 inches. The angle A is preferably about 120° or less. H and W are each preferably less than about 0.75R but preferably more than about 0.25R. The sum of H and W can be as great as 1.75R at the most and above 0.75R at the least.

Figure 8:
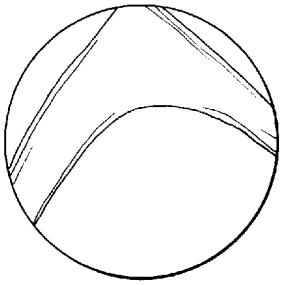
Figure 9:
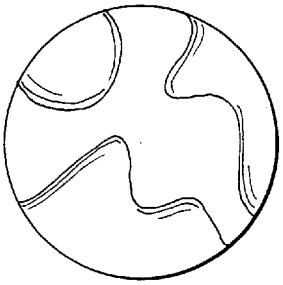
Figure 10:
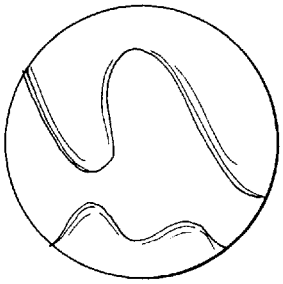

The depressions are defined by curvilinear sides to avoid stress risers, generally speaking. As viewed in the end view of the interface in FIGS. 5–14 inclusive, depressions are provided with curving sides as a generalization. Special emphasis should be noted with regard to the sides in FIGS. 8 and 12. FIG. 8 has a pair of converging chords which appear in the end view to be straight lines. The chords of FIG. 8 however are the defining edges of curving depression walls. In other words, it is optimum that the walls in the depressions of FIG. 8 curve or dish inwardly into the depressions. Furthermore, the depressions in FIG. 12 are typically dished when viewed in cross-section. Indeed, FIG. 12 shows depressions which are very much like those reflected in FIG. 1 of the drawings. The curvilinear depression edges are therefore to be considered in two dimensions, i.e., the end view which shows the marginal edge of the depressions as seen in FIG. 8 in contrast with the side view in FIG. 1 of the drawings.

For insert bodies which are in the range of 0.5 to 1.0 inches, the depth D can be greater and can be as much as about 0.1 inches. While it can be deeper, where D can be greater, there is sometimes no particular gain in making much greater depth. Therefore and in light of that, the depth can be increased somewhat over the dimension D for the inserts just described.

Figure 11:
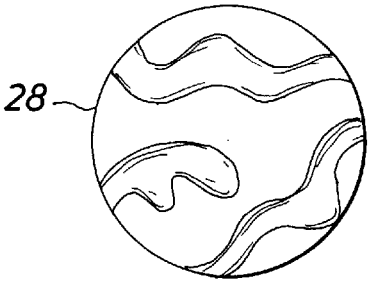
Figure 12:
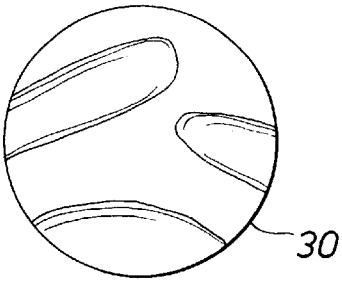

On review of the measurements identified in FIGS. 2, 3, and 4 as applied to FIGS. 5–14, the included angle is measured with respect to the centerline axis. For example, FIG. 11 shows an included angle at which depressions are observed with respect to the centerline axis at practically all regions except the region 28 as marked in FIG. 11. In FIG. 12, there is a similar region 30 where there is no depression as observed from the centerline axis. It will be seen that the embodiments exemplified by the depressions in FIGS. 11 and 12 have an included angle (indicating no depression) where A is less than about 150°. FIG. 8 shows the maximum A measurement where it approaches about 150° or 160°.

The measurements H and W are taken at any relative rotation of the insert body 12. In that sense, the depressions shown collectively in FIGS. 5–14 can be rotated to any particular angle. Then measuring H and W at any particular angle, the sum of the two measurements become significant. As noted, it is preferable that H and W each individually be equal to or greater than about 0.25R. The sum of the two measurements in FIG. 10 approaches 2.00R which suggests that the grip is quite well accomplished in this particular embodiment. It is not necessary to exceed about 1.5R to about 1.7R. Where the sum of H and W is greater than about 1.7R, no particular added benefit is obtained. It does not represent an invalid measurement; rather, it represents an overgripped situation, adding abrasion resistance to the devices.

Figure 6:
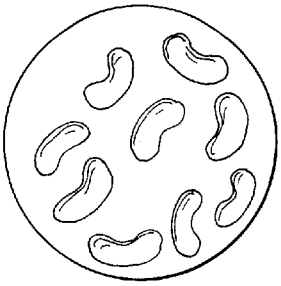
Figure 7:
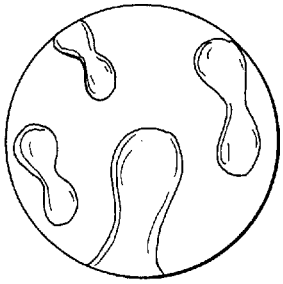

In the remainder of the embodiments not specifically discussed, it will be observed that the depression area as a percent of the cross-sectional area is at least about 25%. The optimum is in the range of about 40% to 60%. By definition, if the depressions represents 100% of the area, there is no depression at all. Therefore, the optimum amount of depression is about 40% to 60%; even with as little as 25%, more than an adequate grip can be held between the two dissimilar materials. In the latter instance, FIG. 6 shows such a representation where the aggregate cross-sectional area of the depressions is relatively small.

In use, curvilinear side depressions in the interface enhance the grip and extend the life of the PDC crown on the WC insert bodies.

While the foregoing is directed to the preferred embodiment, the scope thereof is determined by the claims which follow.

What is claimed is:

1. A cutting element comprising:

a. metal carbide stud having an insert end and an outer end portion;

b. a plurality of random and irregular depressions formed on said outer end portion of said metal carbide stud wherein all sides of said depressions are curvilinear in shape; and c. a layer of polycrystalline material disposed over the depressions at the outer end portion of said metal carbide stud, wherein said curvilinear depressions minimize stress concentration at an interface between said stud and said layer of polycrystalline material wherein said interface is devoid of sharp edges, and wherein said polycrystalline material comprises abrasive particles selected from diamond, cubic boron nitride, wurtzite boron nitride, and mixtures thereof, bonded together as a unitary body and bonded to said stud.

2. The cutting element of claim 1 wherein said metal carbide stud is cylindrical.

3. The cutting element of claim 1 wherein said depressions include only gradual changes in the slope of the surface of the outer end portion of said metal carbide stud.

4. The cutting element of claim 1 wherein said depressions represent about 25% to 60% of the surface area of the outer end portion of said metal carbide stud.

5. The cutting element of claim 1 wherein said plurality of depressions are situated on the outer end portion of said metal carbide stud in an asymmetrical, irregular and random arrangement to minimize stress concentrations in said cutting element.

6. The cutting element of claim 1 wherein said plurality of depressions grouped to define at least two flat regions in the end of said metal carbide stud and said flat regions extend from the middle portions to the outer circumference of said outer end portion of the metal carbide stud.

7. The cutting element of claim 6 wherein the included angle between said flat regions ranges from about 100° to 160°.

8. The cutting element of claim 1 wherein said metal carbide is primarily tungsten carbide particles.

9. The cutting element of claim 1 wherein said plural depressions and the area between said depressions comprise an undulating surface of gradually varying slope, and said area is a portion of said outer end portion so that said end portion has a bonded interface with said layer of polycrystalline material disposed over said depressions to secure said layer to said stud.

10. The cutting element of claim 1 wherein said polycrystalline material varies in thickness over said depressions and said depressions are up to about 0.08 inches where insert diameter is less than about 0.5 inches and are up to about 0.1 inches where insert diameter is up to about 1.0 inches.

11. The cutting element of claim 10 wherein said depressions in the outer end of said metal carbide stud have orthogonal measurements of H and W (height and width) of at least about 0.25 to a sum of less than about 2.00 times insert diameter.

12. The cutting element of claim 11 wherein H and W are defined by depressions wholly within the outer end portion of said insert.

13. An insert for use in a drill bit or cone thereof wherein the insert comprises an elongate cylindrical composite material metal body having a circular end face, a PDC crown bonded in the end face, and wherein the interface between the PDC crown and the WC body includes at least one random and irregular curvilinear depression, and wherein all sides of said depression are curvilinear, and wherein said curvilinear depression minimizes stress concentration between said metal body and said crown and wherein said interface is devoid of sharp edges.

* * * * *